United States Patent [19]

Lemmon

[11] 4,138,048

[45] Feb. 6, 1979

[54] MOTORIZED TINSEL DECORATING TOOL

[76] Inventor: James A. Lemmon, 609 Main St., Boise, Id. 83702

[21] Appl. No.: 802,243

[22] Filed: May 31, 1977

[51] Int. Cl.[2] ..... B65H 17/22

[52] U.S. Cl. ..... 226/152; 226/127; 226/181; 226/188; 226/196; 228/52

[58] Field of Search ..... 226/127, 128, 129–133, 226/152, 156, 168, 181, 188, 91, 196; 219/230; 228/53, 52; 222/146 HE; 242/7.18

[56] References Cited

U.S. PATENT DOCUMENTS

| | | | |
|---|---|---|---|
| 2,656,063 | 10/1953 | Kafka | 226/156 X |
| 2,871,333 | 1/1959 | Savage | 219/230 X |
| 3,599,897 | 8/1971 | Wangerin | 226/91 X |
| 3,690,994 | 9/1972 | Williams | 219/230 X |
| 3,792,228 | 2/1974 | Wei-Cheng | 226/127 X |

*Primary Examiner*—Bruce H. Stoner, Jr.
*Attorney, Agent, or Firm*—Clarence A. O'Brien; Harvey B. Jacobson

[57] ABSTRACT

A body is provided defining an elongated handgrip and an elongated support projecting angularly outwardly of one end portion of the handgrip. A motor is carried by the body and a pair of generally parallel peripherally engaged side-by-side rollers are journaled from the end of the support remote from the handgrip for rotation about axes extending transversely of the support and disposed on opposite sides of a plane extending longitudinally of the support. The end of the handgrip remote from the support rotatably mounts a spool of ribbon therefrom and the handgrip includes guide structure for guiding a ribbon being unwound from the spool along the handgrip and, at the end of the handgrip remote from the spool, toward the rollers. The motor is drivingly connected to one of the rollers and trigger control structure is supported from the body in the included angle defined between the handgrip and the support and the trigger is shiftable between first and second positions with the motor actuated and deactivated, respectively.

3 Claims, 3 Drawing Figures

MOTORIZED TINSEL DECORATING TOOL

BACKGROUND OF THE INVENTION

1. Field of the Invention

During the Christmas holiday season, tinsel is applied to various forms of Christmas decorations. Tinsel is marketed in packages of elongated strands of tinsel which inevitably become tangled and render the application of individual tinsel strips on articles to be decorated very difficult. In addition, tinsel is also utilized in artistic displays during times other than the Christmas season. Accordingly, a need exists for a structure whereby individual strands of tinsel may be applied to articles to be decorated.

2. Description of the Prior Art

Various forms of ribbon dispensers and wire dispensers have been heretofore provided, but most of these are not suited to dispensing fragile tinsel strands.

Examples of previously patented wire and ribbon dispensers as well as other structures including some of the general structural and operational features of the instant invention are disclosed in U.S. Pat. Nos. 2,790,925, 3,206,782, 3,382,398, 3,396,888 and 3,811,611.

BRIEF DESCRIPTION OF THE INVENTION

The motorized tinsel decorating tool of the instant invention is constructed in the general configuration of a pistol including a motor actuating trigger in the conventional trigger position on a pistol. The end of the handgrip portion remote from the trigger rotatably journals a spool of tinsel and the handgrip includes tinsel guide structure for guiding a ribbon of tinsel therealong and directing the ribbon of tinsel forwardly along the elongated support portion of the tool which is oriented relative to the handgrip in substantially the same manner as the barrel of a pistol is oriented relative to the handgrip thereof. The outer end of the support includes a pair of side-by-side peripherally engaged rollers journaled for rotation about parallel axes extending transversely of the elongated support and the ribbon of tinsel is passed between the rollers and is frictionally gripped thereby. A motor is mounted on the tool and is drivingly connected to one of the rollers. Accordingly, upon actuation of the motor the rollers will be driven in opposite directions to feed the ribbon of tinsel from the tool. As a desired length of tinsel ribbon has been dispensed from the tool, it may be cut therefrom in order that the next ribbon section of tinsel may be dispensed from the tool.

The main object of this invention is to provide an apparatus capable of sequentially dispensing long ribbons of tinsel and other ribbon-like decoration material.

Another object of this invention is to provide a ribbon dispensing tool including a large storage capacity for ribbon to be dispensed therefrom.

Still another object of this invention is to provide a ribbon dispensing tool in the general shape of a pistol and with the motor switch actuator of the tool in the form of a trigger mounted in the conventional position of a pistol trigger.

A further object of this invention is to provide a tinsel ribbon dispensing tool which may be readily powered by batteries.

Still another important object of this invention is to provide a ribbon dispensing tool which is of a size and weight enabling it to be used for extended periods of time without tiring the user.

A further important object of this invention is to provide a tinsel ribbon dispenser constructed in a manner whereby the spool of tinsel ribbon to be dispensed therefrom may be readily renewed.

A final object of this invention to be specifically enumerated herein is to provide a tinsel dispenser in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 3:
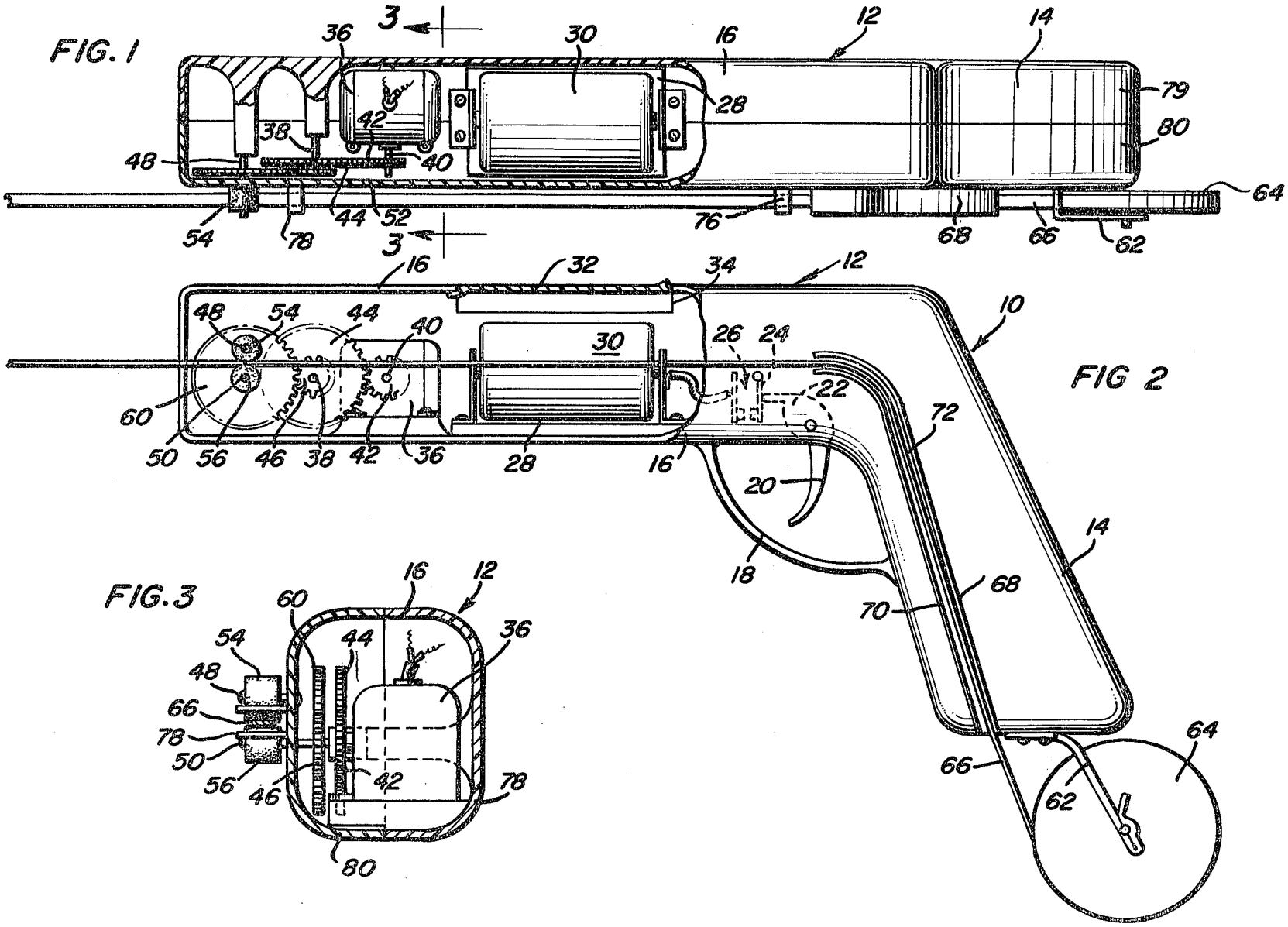
FIG. 1 is a top plan view of the tinsel dispenser of the instant invention with portions of the top wall of the dispenser being broken away and illustrated in horizontal section.
FIG. 2 is a side elevational view of the tinsel dispenser as seen from the left side thereof and with a portion of the near side of the housing of the dispenser being broken away.
FIG. 3 is an enlarged, transverse, vertical sectional view taken substantially upon the plane indicated by the section line 3—3 of FIG. 1.

Referring now more specifically to the drawings, the numeral 10 generally designates the ribbon dispenser of the instant invention. The ribbon dispenser 10 includes a body referred to in general by the reference numeral 12 defining an elongated handgrip 14 terminating at one end in an elongated support 16. The body 12 includes an arcuate trigger guard 18 extending between the adjacent sides of the handgrip 14 and the support 16 and across the included angle defined between the handgrip 14 and the support 16. A trigger-type actuator 20 is oscillatably supported from the body 12 and includes an abutment arm portion 22 within the body 12 engaged with a swingable contact 24 of a switch assembly referred to in general by the reference numeral 26.

The body 12 is hollow and the abutment arm portion 22, contact 24 and switch assembly 26 are enclosed within the end of the support 16 adjacent the handgrip 14.

A battery mount 28 is supported within the support 16 and removably supports a battery 30 therefrom. The body 12 includes a removable top wall portion 32 closing an access opening 34 through which the battery 30 may be replaced when necessary.

The free end portion of the support 16 also encloses an electric motor 36 and a jack shaft 38 extends transversely of the interior of the support 16 and is journaled therefrom. The motor 36 includes an output shaft 40 upon which a gear wheel 42 is mounted and the jack shaft 38 includes a pair of gear wheels 44 and 46 mounted thereon, the gear wheel 42 being meshed with the gear wheel 44.

A pair of roller support shafts 48 and 50 are journaled from the body 12 and project through one side wall 52 thereof and have exteriorly mounted resilient rollers 54 and 56 mounted on their outer ends. The rollers 54 and 56 are peripherally engaged with each other. The shaft 50 has a gear wheel 60 mounted thereon and the gear wheel 46 is meshed with the gear wheel 60. Accordingly, actuation of the motor 36 will cause the roller 56 to be rotated and thus the roller 54 to be rotated.

The end of the handgrip 14 remote from the support 16 includes an endwise outwardly projecting bifurcated mount 62 from which a spool 64 of tinsel ribbon 66 is supported. In addition, the handgrip 14 includes a pair of laterally outwardly projecting generally parallel flanges 68 and 70 between which an elongated laterally outwardly opening groove 72 is defined. The ribbon 66 is slidingly received in the groove 72 and the end of the groove 72 remote from the spool 64 curves outwardly toward the rollers 54 and 56.

The rollers 54 and 56 and the flanges 68 and 70 are disposed on the left side of the body 12. In addition, the left side of the body 12 includes a guide 76 adjacent the end of the groove 72 remote from the spool 64 through which the ribbon 66 is slidingly received and a second guide 78 closely adjacent the rollers 54 and 56 through which the ribbon 66 is also guidingly received.

The body 12 is constructed of right and left halves 79 and 80 which are joined together in any convenient manner. The access opening 34 extends into each of the halves 79 and 80.

The switch assembly 26 is serially connected in an electrical circuit (not shown) electrically connecting battery 30 to the motor 36. Accordingly, the trigger-type actuator 20 may be actuated in the manner of a conventional trigger in order to effect operation of the motor 36. When the motor 36 is actuated, the rollers 54 and 56 rotate in clockwise and counterclockwise directions, respectively, as viewed in FIG. 2 of the drawings and therefore pull the ribbon 66 of tinsel from the spool 64. After a desired length of tinsel ribbon has been dispensed, the tinsel ribbon may be cut closely in front of the free end of the support 16 and the next ribbon section of tinsel may be dispensed from the dispenser 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A motorized flexible ribbon dispensing tool, said tool including a hollow body defining an elongated inclined handgrip and an elongated support projecting, horizontally, angularly outwardly and forwardly of the upper end portion of said handgrip, a motor housed within said support, a pair of generally parallel peripherally engaged side-by-side drive rollers journaled from the forward end portion of said support remote from said handgrip for rotation about axes extending transversely thereof and disposed on opposite sides of a plane extending longitudinally of said support, the other lower end portion of said handgrip including means for rotatably supporting a spool of ribbon from the exterior thereof, said handgrip including exterior guide means for guiding a ribbon being unwound from said spool along said handgrip and, at said upper end portion of said handgrip, toward said rollers, means drivingly connecting said motor to one of said rollers, and trigger control means for said motor supported in the included angle defined between said handgrip and support and shiftable between first and second positions with said motor actuated and deactivated, respectively, said guide means defining an elongated open sided groove extending upwardly along one side of said handgrip and curving forwardly toward the forward free end of said support at the upper end of said handgrip, said rollers being supported outwardly of the side of said support corresponding to said one side of said handgrip and including exposed outer ends facing outwardly of the corresponding side of said support between which a length of ribbon may be laterally inserted, said motor comprising an electric motor and said hollow body housing a storage battery therewithin electrically connected to said motor for actuation thereof by means of electric circuit means having a selectively openable and closeable switch serially connected therein, said trigger control means being operatively associated with said switch for control thereof, said tool being free of ribbon engaging guide structure forward of said rollers.

2. The combination of claim 1 wherein said handgrip includes a pair of outstanding generally parallel flanges extending therealong between which said groove is defined.

3. The combination of claim 1 wherein said support includes a removable side wall portion thereof which may be removed to provide replacement access to said storage battery.

* * * * *